US011105475B2

(12) United States Patent
Zeng et al.

(10) Patent No.: US 11,105,475 B2
(45) Date of Patent: Aug. 31, 2021

(54) LIGHTING APPARATUS

(71) Applicant: XIAMEN ECO LIGHTING CO. LTD., Xiamen (CN)

(72) Inventors: Qingguang Zeng, Xiamen (CN); Xiaoliang Wen, Xiamen (CN); Shouqiang Hou, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 14 days.

(21) Appl. No.: 16/773,571

(22) Filed: Jan. 27, 2020

(65) Prior Publication Data

US 2020/0386376 A1 Dec. 10, 2020

(30) Foreign Application Priority Data

Jun. 4, 2019 (CN) ..... 20191042128.9
Jun. 4, 2019 (CN) ..... 201910483159.6
Jun. 4, 2019 (CN) ..... 201920836079.X
Jun. 4, 2019 (CN) ..... 201920836523.8
Jun. 4, 2019 (CN) ..... 201920836705.5

(51) Int. Cl.

| | |
|---|---|
| ***F21S 8/02*** | (2006.01) |
| ***F21V 29/70*** | (2015.01) |
| ***F21V 23/06*** | (2006.01) |
| ***F21V 23/04*** | (2006.01) |
| ***F21V 7/04*** | (2006.01) |
| ***F21V 21/30*** | (2006.01) |

(52) U.S. Cl.
CPC ..... *F21S 8/026* (2013.01); *F21V 7/04* (2013.01); *F21V 21/30* (2013.01); *F21V 23/04* (2013.01); *F21V 23/06* (2013.01); *F21V 29/70* (2015.01)

(58) Field of Classification Search
CPC ..... F21V 21/30; F21V 23/04; F21V 23/06; F21V 7/04; F21V 29/70
See application file for complete search history.

(56) References Cited

U.S. PATENT DOCUMENTS

| | | | | |
|---|---|---|---|---|
| 9,004,728 | B2 * | 4/2015 | Thompson | F21V 21/14 362/371 |
| 10,247,393 | B2 * | 4/2019 | Clark | F21S 8/026 |
| 2005/0183344 | A1 * | 8/2005 | Ziobro | F21V 21/04 52/20 |
| 2008/0025031 | A1 * | 1/2008 | Wronski | F21S 8/026 362/365 |
| 2011/0141741 | A1 * | 6/2011 | Engstrom | F21V 21/04 362/257 |

* cited by examiner

*Primary Examiner* — Rajarshi Chakraborty
*Assistant Examiner* — Michael Chiang
(74) *Attorney, Agent, or Firm* — Chun-Ming Shih; Lanway IPR Services

(57) ABSTRACT

A lighting apparatus may include a housing. A supporting structure is on an inner surface of the housing. A rotating frame is within the housing. The rotating frame is rotated on the supporting structure. A light emitting assembly includes a heat sink and a circuit board. The circuit board is within the heat sink. A light source is included in the lighting apparatus. A driving circuit is connected to the light source. A power socket structure is connected to a power supply to provide a power to the lighting apparatus on the circuit board. The light emitting assembly is connected to the rotating frame.

19 Claims, 11 Drawing Sheets

LIGHTING APPARATUS

FIELD

The present invention is related to a lighting apparatus and more particularly related to a downlight fixture.

BACKGROUND

Downlight is a kind of lighting fixture that is embedded in the ceiling and projects downwards. With this kind of concealed fixtures, all lights are projected downwards and fall in the group of direct distribution. Reflectors, lenses, blinds and lightbulbs can be added to achieve different lighting effects. They are particularly neat and unobtrusive in their appearance, since almost the entire downlight fitting is concealed behind a ceiling or other suitable panel or surface, whilst giving out a pleasing light. Downlight may not take up much space but may increase amiable ambiance. In order to create a cozy and homely atmosphere, try installing multiple downlight to lessen the oppression given off by the room. Downlight is generally used at shopping centers, hospitals, schools, supermarkets, offices, high-end mansions or else, as focus lighting, to brighten, beautify, and add color to the environment.

Among the fixtures, the light emitting assembly of the rotating downlight rotates. However, the current version of the light emitting assembly and ring surface rotates differently, leading to negative reviews and inconvenience. The new version aims to provide a rotating downlight to fix the technical issue that caused the light emitting assembly and ring surface to rotate differently.

SUMMARY

An embodiment of a lighting apparatus includes a housing. A supporting structure disposes on an inner surface of the housing. A rotating frame disposes within the housing. The rotating frame is rotated on the supporting structure.

An embodiment of the lighting apparatus includes a ring surface and a guiding frame. The guiding frame may be made in a ring-shaped. The ring-shaped guiding frame is attached to an outside of the ring surface. Some parts of the circular-shaped guiding frame are extended to the inner of the ring surface so as to form a circular track. The lighting apparatus also includes a rotating frame. The rotating frame may be inserted within the ring surface and compatible with the circular track stated above. The light apparatus includes a light emitting assembly. The light emitting assembly is placed within the ring surface. The light emitting assembly is connected to the bottom of the rotating frame.

In an embodiment, a light emitting assembly includes a heat sink. The light emitting assembly may consisted of a bowl-shaped heat sink, a driver on board light emitting assembly, a reflective optic, and a transparent cover. The bowl-shaped heat sink is connected to a connecting portion. The driver on board light emitting assembly is installed within the heat sink. The reflective optic is installed within the heat sink. The transparent cover is installed within the reflective optic.

A circuit board is within the heat sink. A driving circuit is connected to a light source and a power socket structure is connected to a power supply to provide a power to the lighting apparatus on the circuit board. The light emitting assembly may be a driver on board (DOB). The driver on board is slowly gaining popularity. The driver on board is basically a chip that acts like a driver. The driver on board may be a solid-state device without decay element. When connects in tandem with light emitting diode strings, the current very closely follows the voltage pattern. With the change in voltage, the current changes, thereby changing the brightness of the light emitting diodes.

In an embodiment, a lighting apparatus includes a guiding frame generally in a ring-shaped, and at least two portions of the guiding frame are penetrated through the housing via a plurality of duding slots of the housing to form the supporting structure. The guiding frame may include a first top portion, and a first side portion. The first side portion is connected to the first top portion. A guiding element is formed on one end of the first side portion opposite to the first top portion, and the guiding element extends along a direction opposite to a radial direction of the guiding frame. The guiding frame is formed by segments connecting to each other. The segments may be connected in several ways. The segments may be fixed by a screw or by a snap. The segments may also be fixed by both, one side by the screw and the other side by the snap. An amount of the segments may be just one or two or more.

In an embodiment of a lighting apparatus, the rotating frame is generally in the ring-shaped and includes a second side portion, a first bottom portion and a third side portion. The second side portion, the first bottom portion and the third side portion are connecting in sequence. The first bottom portion is against the guiding element. The second side portion is against an inner surface of the housing.

The guiding element also includes a first limiting protrusion. The first limiting protrusion is configured on the guiding element and extends along the direction opposite to the radial direction of the guiding frame. The rotating frame includes a second limiting protrusion and extends along a direction parallel to an axial direction of the guiding frame. The first limiting protrusion interferes with the second limiting protrusion.

In an embodiment of a lighting apparatus, a switch module is on the first limiting protrusion. The switch module is electrically connected to the driving circuit. In addition, the switch module is to transmitting turn-off signals to the driving circuit upon the first limiting protrusion interfering with the second limiting protrusion, and the driving circuit is to turn off the light apparatus when receiving the turn-off signals.

A first cantilever and a second cantilever are formed to a side of the first bottom portion away from the second side portion. The first cantilever and the second cantilever are opposite to each other and are configured to hold the light emitting assembly. Each of the first cantilever and the second cantilever includes a first connecting portion connected to the first bottom portion. The cantilever may be in various shape, such as 3-shaped or C-shaped or else. A second connecting portion connected to the first connecting portion and the light emitting assembly. The first connecting portion and the second connecting portion may be in a 7-shaped. The second connecting portion has a third limiting protrusion.

The heat sink is to maximize a surface area in contact with the cooling medium surrounding it, such as air. Air velocity, choice of material, protrusion design and surface treatment are factors that affect the performance of a heat sink. The heat sink attachment methods and the thermal interface materials also affect the temperature of the integrated circuit. Thermal adhesive or thermal grease improve the performance of the heat sink by filling air gaps between the heat sink and the heat spreader on the device. The heat sink includes a limiting slot corresponding to the third limiting protrusion. The third limiting protrusion is being fixed to the limiting slot. The light emitting assembly is connected to the rotating frame. The heat sink includes a reflective optic on an inner surface of the heat sink. The reflective optic has a wave-shaped surface.

The lighting apparatus includes a lighting fixture connecting structure configured on the housing. The lighting fixture connecting structure to fix the lighting apparatus to an external lighting fixture. The lighting fixture connecting structure includes a bar, a first elastic sheet holder, and a second elastic sheet holder. Each of the first elastic sheet holder and the second elastic sheet holder includes a holding portion and a fixing portion connected to one end of the holding portion. The holding portion substantially extends along a direction parallel to a longitudinal direction of the bar and is on the bar. The fixing portion is substantially perpendicular to the holding portion. A guiding groove is formed on each of the holding structures along the longitudinal direction of the bar. A first fastener is penetrated through the guiding groove, and the first fastener is movably connected to the first elastic sheet holder on the bar.

The lighting fixture connecting structure also includes at least one adjusting member. The at least one adjusting member extends along the direction parallel to the longitudinal direction of the bar. A first end of the adjusting member is connected to a side of the bar, and a second end of the adjusting member is movably connected to the side of the holding portion. The adjusting member and the side of the elastic sheet holder may have several ways to be connected to each other. The adjusting member and the side of the elastic sheet holder may be connected by pit and bump fixing together. The adjusting member and the side of the elastic sheet holder may also be connected by magnet.

There are notches disposed on the side of the holding portion corresponding to the second end of the at least one adjusting member. The at least one adjusting member includes an adjusting protrusion extending along a direction facing toward the bar, and the adjusting protrusion is movably connected to one of the notches.

The at least one adjusting member is fixed to the bar via a fixing part extending from the bar. The at least one adjusting member includes a first positioning side wall and a second positioning side wall is on the end of the at least one adjusting member fixing to the bar. The first positioning side wall is adjacent to the second positioning side wall. The first positioning side wall and the second positioning side wall extend along a direction facing toward the bar and abut against two adjacent sides of fixing part.

The power socket structure includes a shell and a plurality of metal terminals. There are openings formed on one side of the shell. Installation slots are formed on the opposite side of the shell. The plurality of openings respectively corresponds to the installation slots. An end of the metal terminals is in one of the installation slots, and another end of the metal terminals electrically connects to the circuit board.

The end of the metal terminals may be in the installation slots including a fourth side portion and a fifth side portion opposite to the fourth side portion. The fourth side portion and the fifth side portion are against the plurality of installation slots. A first contact portion and a second contact portion are connected to the first side portion and the second side portion respectively. The first contact portion extends toward the second contact portion. The second contact portion extends toward the first contact portion, and the first contact portion and the second contact portion cooperatively formed a horn-shaped through a hole. An elastic protrusion is formed on the first side portion and extends toward the first contact portion. The end of the first contact portion has a contact end formed in a round shaped.

In an embodiment, the longitudinal section of the guiding frame is shaped like "L"-shaped. The longitudinal section of the guiding frame is consisted of a first top portion and a first side portion. The first top portion and the first side portion is connected together. An end of the first side portion extends along a periphery to form multiple guiding elements within. The guiding elements are paralleled to the first top portion. There are a lot of guiding slots along the periphery of the ring surface. Each guiding element go through and are in one-to-one correspondence with the guiding slots. The first top portion and the first side portion are respectively attached closely to the outer surface of the ring surface, forming a circular track between the inner wall of the guiding elements and ring surface.

In an embodiment, the guiding frame includes the docking first and second guides which forms a circle. The first and second guides are both arch-shaped. In an embodiment, the rotating frame is annular. The longitudinal section is shaped like "U"-shaped. The longitudinal section is consisted of the second side portion, the first bottom portion, and the third side portion of the secondary connection. The first bottom portion is connected to the guiding elements. The second side portion is connected to the inner wall of the ring surface.

In an embodiment, at least one of other end of the guiding elements is far from the first side portion and is set with a first limiting protrusion. The first bottom portion is provided with a second limiting protrusion extending in the direction of the guiding element. The second and first limiting protrusion act in concert to restrain the rotating angel of the rotating frame within the circular track.

In an embodiment, the rotating frame is made from stamping metal sheets. Metal stamping is a manufacturing process used to convert flat metal sheets into specific shapes. Metal stamping may include a number of metals forming techniques such as blanking, punching, bending and piercing, to name a few. Metal stamping is a fast and cost-effective solution for a large-quantity manufacturing need. Manufacturers who need metal parts stamped for a project are generally looking for three important qualities, high quality and durability, low cost, and fast turnaround time. The thickness of the metal sheet is approximately one to three millimeters.

In an embodiment, the further end of the first bottom portion is provided with the first cantilever extending in the direction of the light emitting assembly. The further end of the first bottom portion is also provided with the second cantilever extending in the direction of the light emitting assembly. The first is set at relative positions. The second cantilever is also set at relative positions. Both of the further ends of the first and second cantilever is attached to the light emitting assembly.

In an embodiment, both of the first and second cantilever contains the first connecting portion that is connected to the first bottom. And the first connecting portion is connected to the second connecting portion through the light emitting assembly. The first connecting portion is preferably 7-shaped.

In an embodiment, the third limiting protrusion is set on the second connecting portion. Limiting slots may be found on both sides of the heat sink. Positioning slots may also be found on both sides of the heat sink. The limiting slots act in concert with the third limiting protrusion in order to prevent rotating differences between the heat sink and the rotating frame. The remote end of the second connecting portion receives by the corresponding positioning slot and is connected to the heat sink by using rivets.

In an embodiment of the rotating downlight has shown the following effects. With a rotating combination of attaching a rotating frame onto a guiding frame, the rotation on the circular track may be capable. In addition, by attaching the light emitting assembly to the bottom of the rotating frame, the light emitting assembly may rotate with the rotating frame, lighting up all directions. As the rotating frame is rotating on the circular track, during the rotation of the rotating frame, the light emitting assembly may have the same concentric velocity as the ring surface. The combination of the rotating frame and the guiding frame make the rotation smoother, resulting in good user feedbacks.

DETAILED DESCRIPTION

Reference may now be made in detail to particular embodiments of the disclosure, examples of which are illustrated in a plurality of accompanying drawings. While the disclosure may be described in conjunction with the preferred embodiments, it may be understood that they are not intended to the limit the disclosure to these embodiments. On the contrary, the disclosure is intended to cover alternatives, modifications and equivalents that may be included within the spirit and scope of the disclosure as defined by the appended claims. Furthermore, in the following detailed description of the present disclosure, numerous specific details are set forth in order to provide a thorough understanding of the present disclosure. However, it may be readily apparent to one skilled in the art that the present disclosure may be practiced without these specific details.

Figure 1:
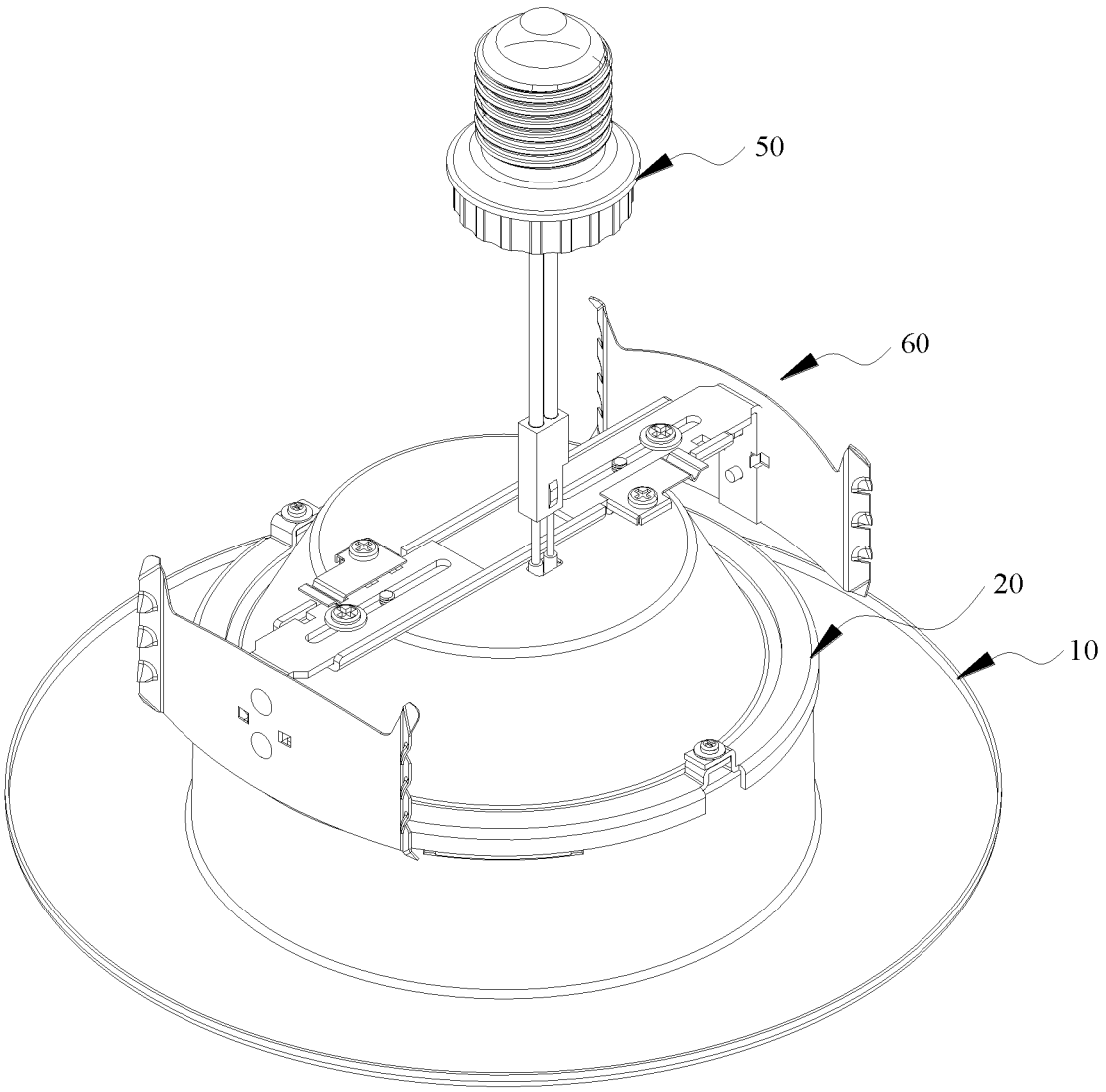
FIG. 1 is a perspective view of a structure of an embodiment of a lighting apparatus.
Figure 2:
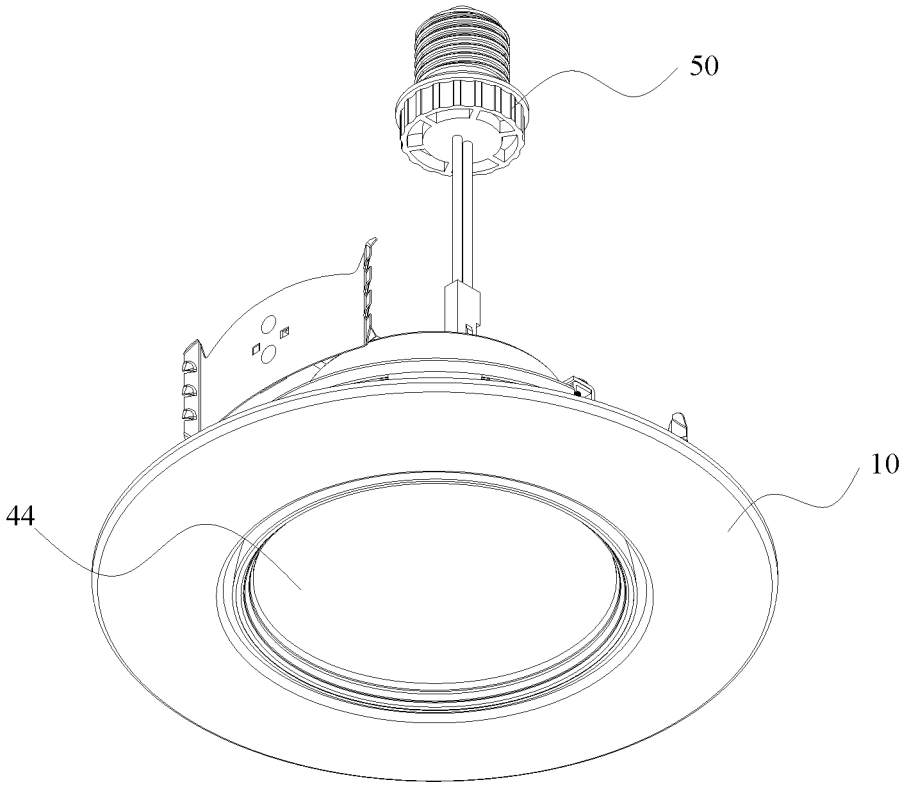
FIG. 2 is a perspective view of a structure of an embodiment of a lighting apparatus.
Figure 3:
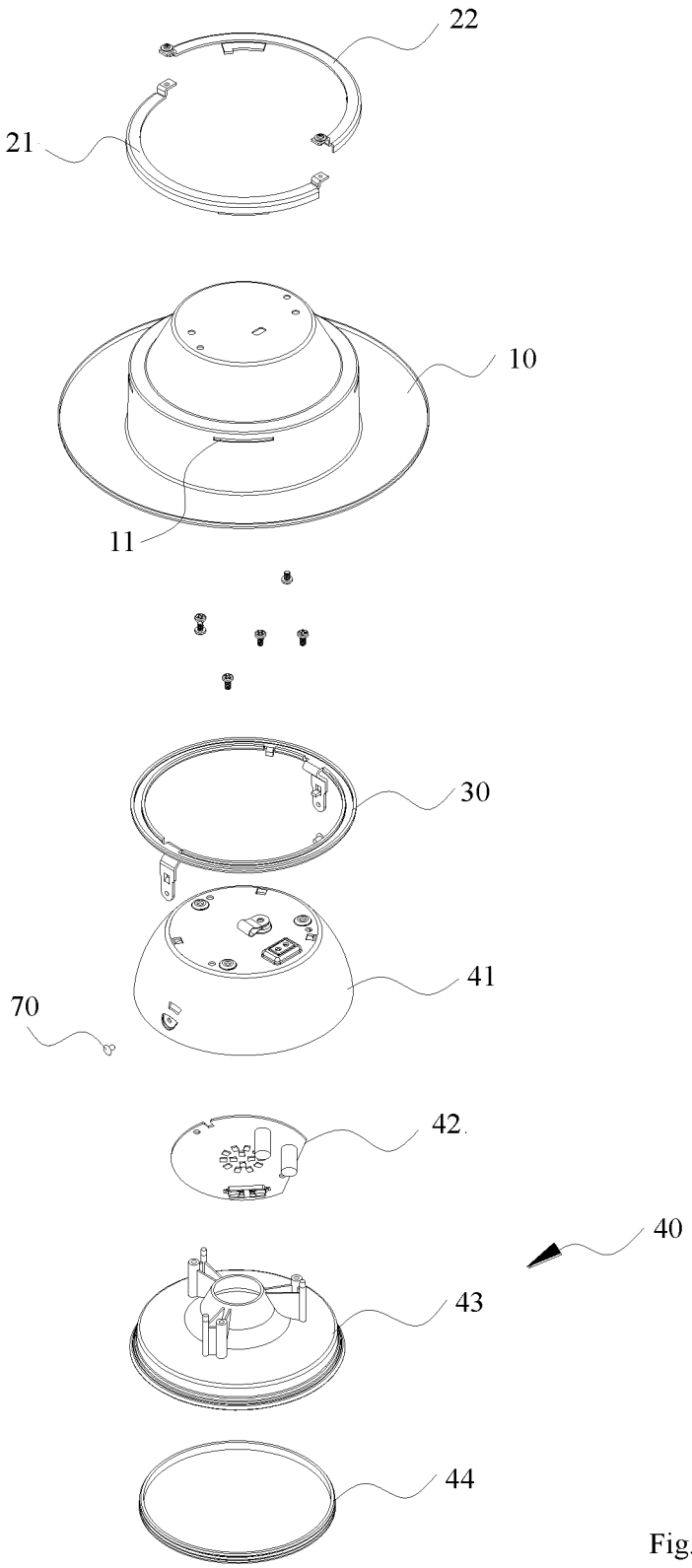
FIG. 3 is an exploded view showing part of a structure of an embodiment of a lighting apparatus.

Referring FIG. 1, FIG. 2 and FIG. 3, it shows the newer version of the rotating downlight demonstrated in the embodiment. FIG. 1 is a perspective view of a structure of an embodiment of a lighting apparatus. FIG. 2 is another perspective view of a structure of an embodiment of a lighting apparatus. FIG. 3 is an exploded view showing part of a structure of an embodiment of a lighting apparatus. It contains ring surface 10, guiding frames 20, rotating frames 30, and light emitting assembly 40. The following description will be based on the rotating direction in FIG. 1. The guiding frame 20 is ring shaped, circular, and is installed on the outside of the ring surface 10. Parts of the guiding frame 20 extends into the ring surface 10 and forms a circular track within. The rotating frame 30 is installed within ring surface 10, is compatible with the circular track and can rotate on the circular track. Light emitting assembly 40 is installed within the ring surface 10 and is defaulted to be attached to the bottom of the rotating frame 30. It will be able to rotate simultaneously with rotating frame 30, aligning the light emitting assembly 40 with the ring surface 10, to secure a higher optical quality. When the rotating frame 30 is attached onto the circular track within the ring surface 10 and rotating through the circular track on the guiding frame 20, brings the light emitting assembly 40 in rotation, to light up in all directions and provide a better user experience.

Please refer to FIG. 3, in an embodiment the ring surface 10 is cylindrical. It can be consisting of multiple different diameter cylindrical, and the ring surface 10 is made in one piece with metal or plastic materials, with one end sealed, and the other end open. Rotating frame 30 and the light emitting assembly 40 will be inserted within the ring surface 10 from the open end.

In an embodiment, a combination of the rotating format with guiding frame 20 and rotating frame 30 has been applied. Once the rotating frame 30 has been inserted into guiding frame 20, it can rotate in the circular track. The light emitting assembly 40 will be attached at the bottom of the rotating frame 30, bringing the light emitting assembly 40 and the rotating frame 30 into rotation. All directions may be light up. As a result of the rotation of rotating frame 30 on the circular track, when the rotating frame 30 rotates, the light emitting assembly 40 and the ring surface 10 will be in sync. Eccentricity will not occur. Furthermore, the appliance of combining guiding frame 20 and the rotating frame 30 helps with rotation, resulting in better user feedback.

Figure 4:
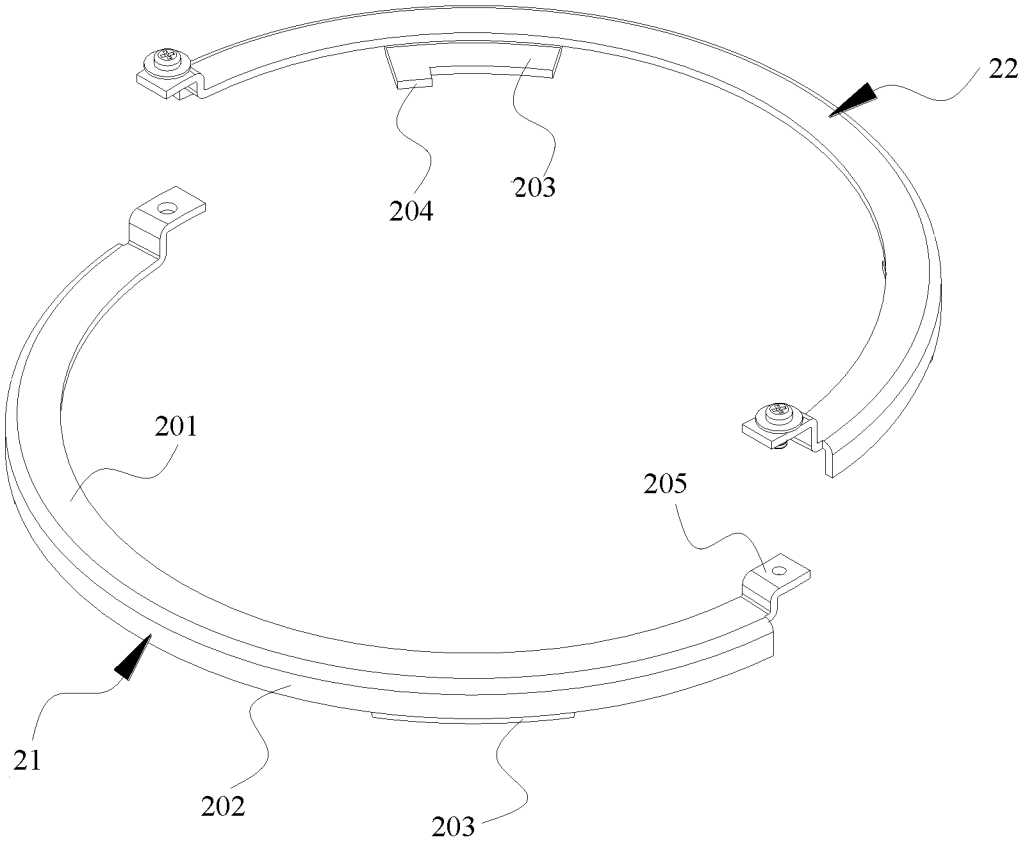
FIG. 4 is an exploded perspective view of a guiding frame of an embodiment of a lighting apparatus.

Please refer to FIG. 4 for the following description. FIG. 4 is an exploded perspective view of a guiding frame of an embodiment of a lighting apparatus. In an embodiment, the longitudinal section of the guiding frame 20 is preferably"-shaped, consisting of the interconnected first top portion 201 and first side portion 202. The first top portion 201 is perpendicular to the first side portion 202, and the remote end of the first side portion 202 that is not connected to the first side portion 201 extends along the periphery and towards the center of the guiding frame 20 and extends into multiple guiding element 203. The guiding element 203 is parallel with the first top portion 201. Correspondingly, the ring surface 10 has multiple guiding holes 11 along the periphery. The guiding hole 11 and guiding element 203 will match accordingly. The shape of every guiding element 203 matches and goes through the guiding hole 11. In an embodiment, when the guiding frame 20 is attached onto the ring surface 10, the first top portion 201 and the first side portion 202 can be found closely attached to the outer surface of the ring surface 10 separately. Multiple guiding element 203 forms a circular track within the inner wall of the ring surface 10. In this appliance, the first top portion 201, the first side portion 202 and the guiding element 203 are made all in one-piece in order to simplify the structure and reduce the cost.

Please refer to FIG. 3 and FIG. 4. In an embodiment, the guiding frame 20 includes the first guiding track 21 and the second guiding track 22. Among them, the first guiding track 21 and the second guiding track 22 connects to form a circular shape and the first guiding track 21 and the second guiding track 22 both contains the above mentioned first top portion 201, first side portion 202 and guiding element 203. In an embodiment, the structure of the guiding frame 20 is designed as two connected parts. This will strengthen the structure and is convenient for installing and disassembling. In this appliance, both ends of the first guiding track 21 and second guiding track 22 extends and is equipped with bend portion 205. The bend portion 205 can be formed by bending the end of the first guide 21 and the second guide 22. The bend portion 205 is made by bending the first top portion 201 upwards, and the bending part of the bend portion 205 is preferably"-shaped. The bend portion 205 of the first guide 21 and the bend portion 205 of the second guide 22 is securely connected with a fastener. Therefore, when rotating frame 30 rotates, it may not become loose or deformed. The fastener may be in the form of screws and such. When assembling, insert the first guide 21 and the guiding element 203 of the second guide 22 into the corresponding guiding slot 11 of the ring surface 10. Use the fastener to secure the first guide 21 and the second guide 22 when in position. The assembly of the guiding frame 20 and ring surface 10 may be complete.

In order to form a circular shape, the first guide 21 and the second guide 22 are all arc shaped. Preferably, both the first guide 21 and the second guide 22 are semicircular.

Figure 5:
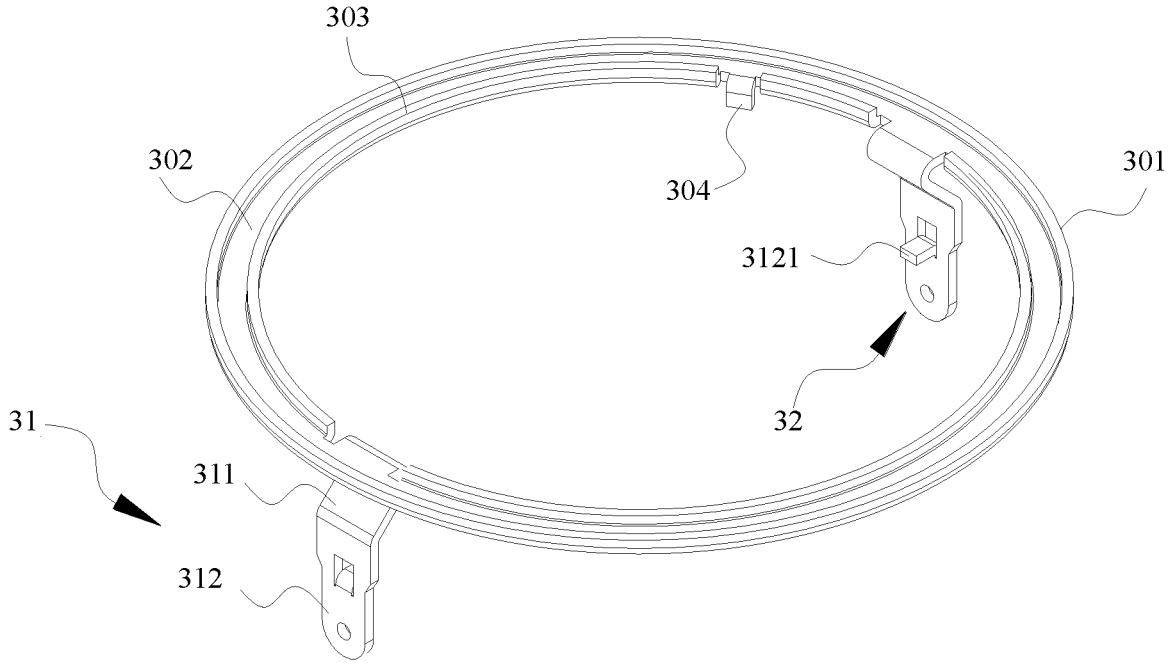
FIG. 5 is a perspective view of a rotating frame of an embodiment of a lighting apparatus.

Please refer to FIG. 5 for the following description. FIG. 5 is a perspective view of a rotating frame of an embodiment of a lighting apparatus. In an embodiment, a rotating frame 30 is similar to a circular shape. It is compatible with the circular track. The longitudinal section of the rotating frame 30 is preferably "U"-shaped. The rotating frame 30 includes a connection of the second side portion 301, the first bottom portion 302 and a third side portion 303. The second side portion 301 is positioned on the outside and the third side portion 303 on the inside. The second side portion 301, and the first bottom portion 302 and the third side portion 303 connects to form a "U"-shaped.

Figure 7:
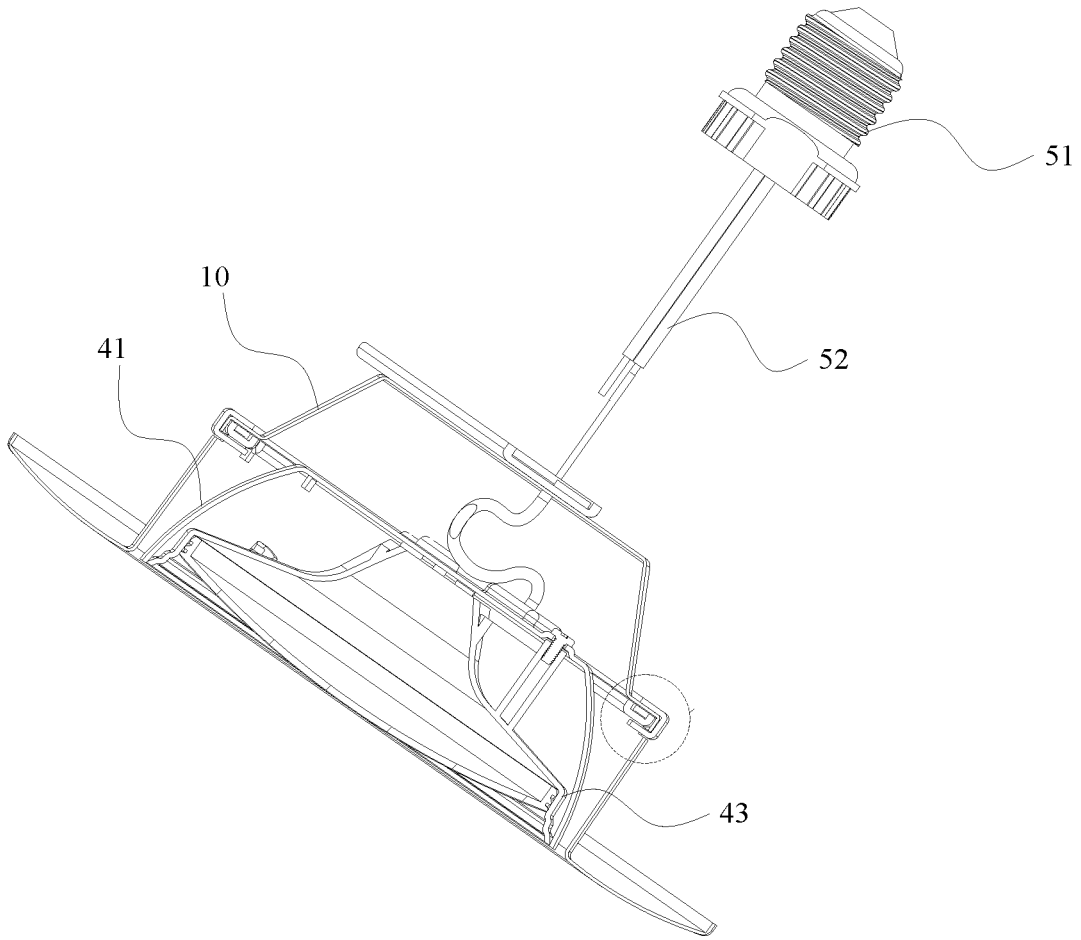
FIG. 7 is a cross sectional view of a part in an embodiment of a lighting apparatus.
Figure 8:
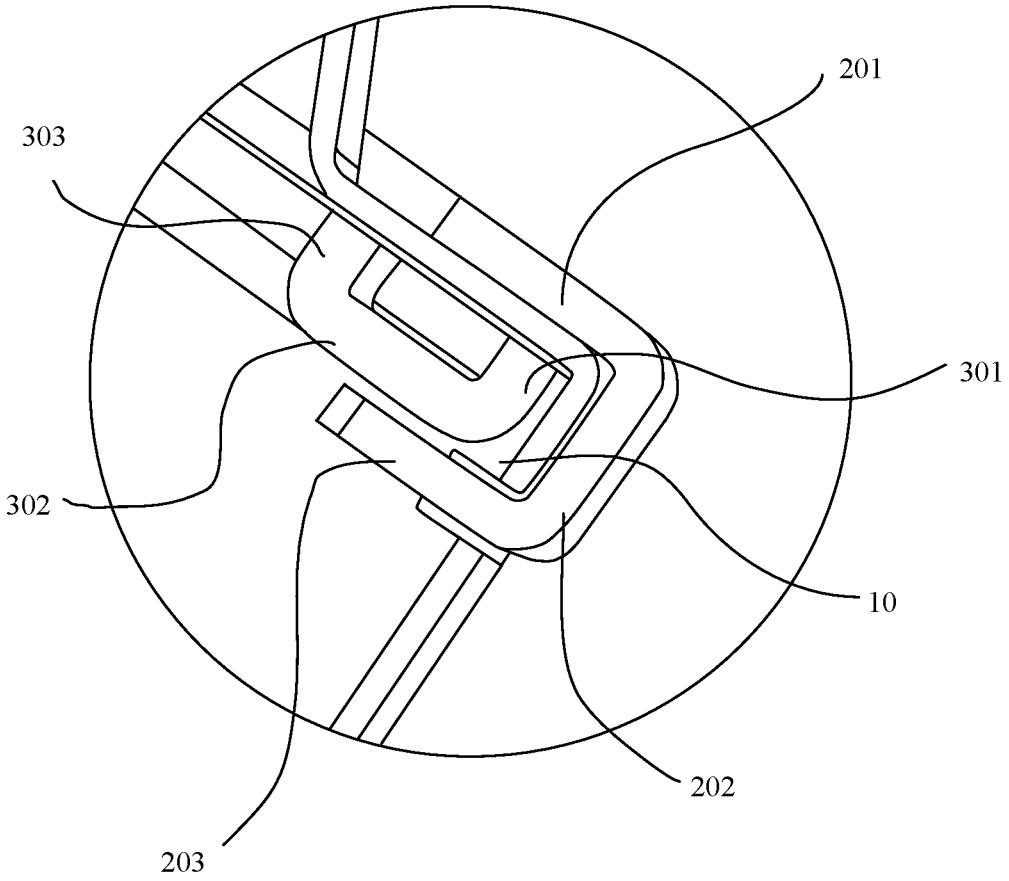
FIG. 8 is a detailed view of an area in FIG. 7 according to an embodiment of the present disclosure.

The following description will be based on FIG. 7 and FIG. 8. FIG. 7 is a cross sectional view of a part in an embodiment of a lighting apparatus. FIG. 8 is a detailed view of an area in FIG. 7 according to an embodiment of the present disclosure. When the rotating frame 30 is attached onto the circular track, the first bottom portion 302 of the rotating frame 30 connects with the guiding element 203. The bottom of the second side portion 301 connects with the inner wall of the ring surface 10. In an embodiment, the second side portion 301, the first bottom portion 302 and the third side portion 303 is made in one piece to simplify the structure and cut down cost. In particular, the rotating frame 30 is made of compressed metal plate, and there is a standard of the thickness for the metal plate. With design, once the model for the rotating frame 30 is set, it may not be easily deformed. This adds smoothness to the rotation of the rotating frame 30, and a plurality of feedbacks from is positive. Regarding the thickness of the metal plate, it is capable of being anywhere between one mm to three mm. It may be one mm, one point five mm, two mm, two-point five mm, or three mm, to name a few. One point five mm is the most recommended.

Please refer to FIG. 4 and FIG. 5 for the following description. In an embodiment, at least the remote end of one of the guiding elements 203 extends and is connected with the first limiting protrusion 204. Correspondingly, the first bottom portion 302 towards the guiding element 203 extends and is connected with a second limiting protrusion 304. The second limiting protrusion 304 and the first limiting protrusion 204 act in concert to limit the rotation angle of the rotating frame 30 when rotating on the circular track. The first limiting protrusion 204 and the second limiting protrusion 304 are both roughly in the shape of a square. The first limiting protrusion 204 and the guiding element 203 is made in one piece. The second limiting protrusion 304 and the first bottom portion 302 is made in one piece. In an embodiment, one of the guiding elements 203 is connected with the first limiting protrusion 204. The second limiting protrusion 304 is set on the rotating frame 30 to be compatible with the first limiting protrusion 204. This may prevent the rotation angle of the rotating frame 30 to rotate more than three hundred and sixty degrees within the circular track. This may lower the risk of damaging a lightbulb wire when rotating.

Referring to FIG. 5 for the following description. In an embodiment, the remote end of the first bottom portion 302 extends towards the light emitting assembly 40 and is connected with the first cantilever 31 and the second cantilever 32. The first cantilever 31 and the second cantilever 32 is set as counterparts. The second cantilever 32 is further away from the first bottom portion 302. The remote end of both the first cantilever 31 and the second cantilever 32 is connected with the light emitting assembly 40 accordingly. In an embodiment, by placing the light emitting assembly 40 through the first cantilever 31 and the second cantilever 32, and securely connecting it to the bottom of the rotating frame 30, may benefit to the rotation of the rotating frame 30 and may be user friendly. In the appliance, the first cantilever 31 and the second cantilever 32 are both in one piece with the rotating frame 30, in order to simplify the structure and reduce cost.

To specify, the first cantilever 31 and the second cantilever 32 are both equipped with the first connecting portion 311 and the second connecting portion 312. Among them, an end of the first connecting portion 311 is made to connect with the first bottom portion 302. The other end of the first connecting portion 311 is made to connect with the second connecting portion 312. The remote end of the second connecting portion 312 that is further away from the first connecting portion 311 is made to connect with the light emitting assembly 40. In an embodiment, the first connecting portion 311 is preferably 7-shaped in order to prevent deformation during the rotation of the rotating frame 30. The first connecting portion 311 in a 7-shaped may also keep it from affecting other parts. In the appliance, the first connecting portion 311 and the second connecting portion 312 is in one piece that aims to simplify the structure, reduce cost, and enhance its hardness.

Please refer to FIG. 1, FIG. 2, FIG. 3, FIG. 6, and FIG. 7 for the following description. In an embodiment, the light emitting assembly 40 includes a heat sink 41, a DOB (Driver on board) light emitting assembly 42, a reflective optic 43, and a translucent cover 44. Among them, the heat sink 41 is shaped like a bowl with one end closed and the other open. The heat sink 41 is installed within the ring surface 10 through an open end of the heat sink. The heat sink 41 is made with metal material, to make the dissipation of heat more effective. Driver on board light emitting assembly 42 is installed at the bottom of the heat sink 41. The reflective optic 43 is installed within the heat sink 41. The translucent cover 44 is installed within the reflective optic 43 and uses the buckles within the reflective optic 43 to lock in. The reflective optic 43 and the translucent cover 44 is both installed within the heat sink 41. It is connected to the heat sink 41 via fastener, with screws and other associations.

In an embodiment, the driver on board light emitting assembly 42 includes a plurality of substrates. A light source, a driving circuit, a plurality of terminals and a plurality of electronic components are on the substrate.

Among them, the light source may comply with LED lights. Once the LED light and the driving circuit is built on the substrate, and the independent driver may be eliminated. This will lessen the amount of parts. With a lot of LED lights, arranging LED lights evenly according to a certain pattern on the substrate may connect in series or parallel with one another.

Figure 6:
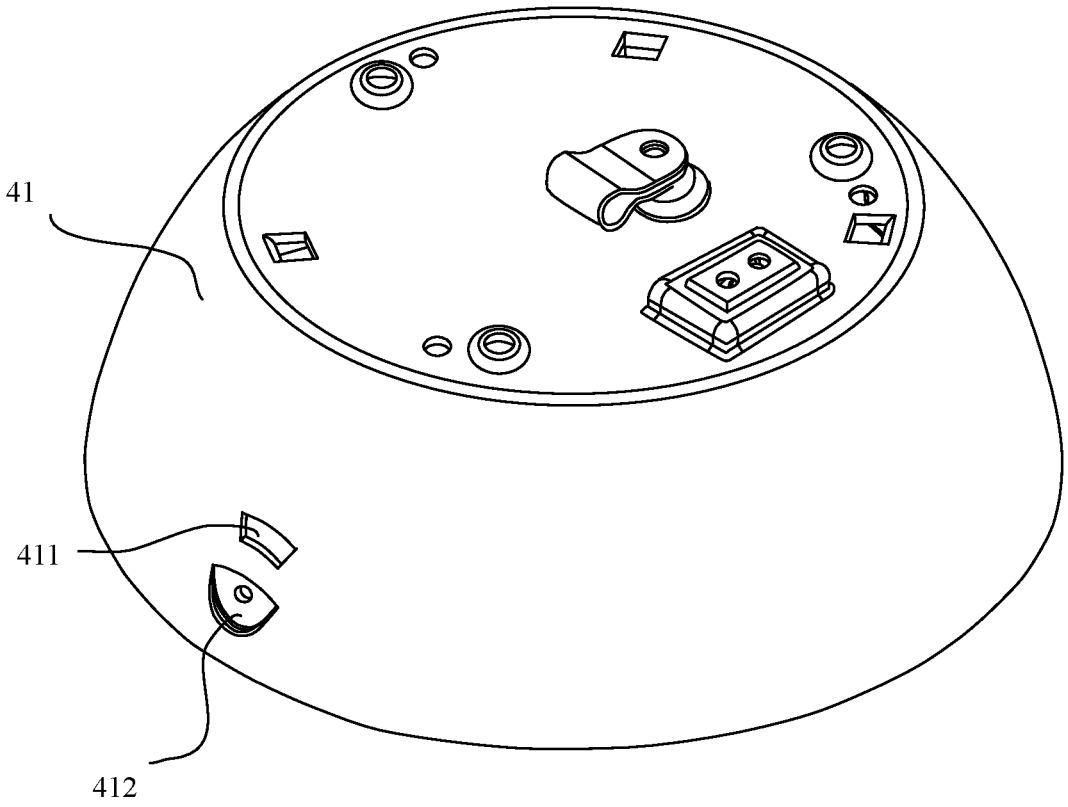
FIG. 6 is a perspective view of a heat sink of an embodiment of a lighting apparatus.

Referring to FIG. 5, in an embodiment the second connecting portion 312 of the first cantilever 31 and the second cantilever 32 is connected with the third limiting protrusion 3121. Referring to FIG. 5 and FIG. 6, correspondingly, the heat sink 41 has limiting slots 411 on both sides. The limiting slot 411 is compatible with the third limiting protrusion 3121 in order to prevent joint rotation between heat sink 41 and rotating frame 30. Among them, the third limiting protrusion is square-shaped, and the limiting slot 411 is arch-shaped. In addition, positioning slots 412 are on both sides of the heat sink 41. The remote end of the second connecting portion 312 is further from the first connecting portion 311. The remote end is made to be compatible within the positing slot 412. The heat sink 41 may be connected to rivet 70 via rivet.

Please refer to FIG. 1, FIG. 2, and FIG. 7 for the following descriptions. In an embodiment, the rotating downlight contains lamp holder modules 50 and an elastic sheet structure 60. The rotating downlight passes through the lamp holder modules 50 to reach power. Among them, the lamp holder modules 50 include lamp holder 51 along with wire connections 52. Lamp holder 51 may use it to access external power supplies and may also use it to connect with a terminal to achieve lamp holder 51 and the electrical connection of the driver on board light emitting assembly 42. In detail, one end of the wire connections 52 is connected to the lamp holder 51 and connects the other end through ring surface 10 and the terminal of the heat sink 41. The elastic sheet structure 60 is installed on the back of the ring surface 10. The elastic sheet structure 60 will be applied when inserting the rotating downlight into the ceiling. The lamp holder modules 50 contains two wire connections 52. One is positive, and the other one is negative. The two wire connections 52 may go through the ring surface 10 and the heat sink 41 separately and connect to the terminal for electrical connection.

Figure 9:
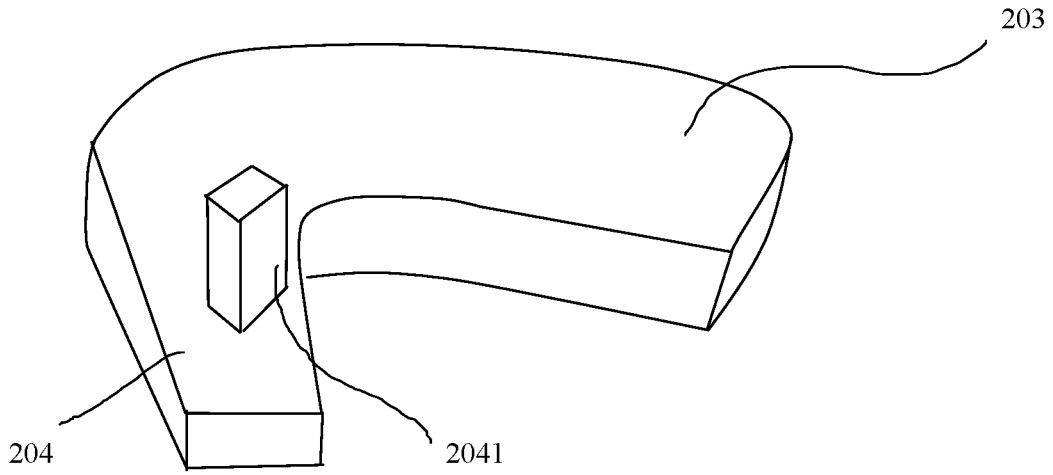
FIG. 9 is a schematic view illustrating a guiding element according to an embodiment of the present disclosure.

Referring to FIG. 9, a guiding element 203 may include a first limiting protrusion 204 and a switch module 2041. The switch module 2041 is on the first limiting protrusion 204, and the switch module 2041 is electrically connected to the driving circuit and is arranged to transmitting turn-off signals to the driving circuit upon the first limiting protrusion interferes with the second limiting protrusion, and the driving circuit is arranged to turn off the light apparatus when receiving the turn-off signals.

Figure 10:
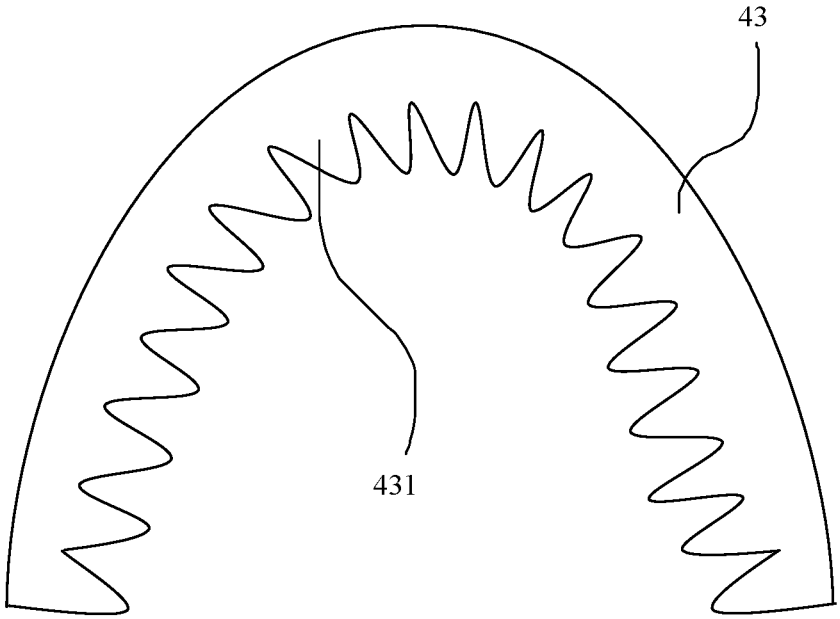
FIG. 10 is a schematic view illustrating a reflective optic according to an embodiment of the present disclosure.

FIG. 10 is a schematic view illustrating a reflective optic according to an embodiment of the present disclosure. Referring to FIG. 10, a heat sink includes a reflective optic 43 fixing on an inner surface of the heat sink. The reflective optic 43 has a wave-shaped surface 431.

Figure 11:
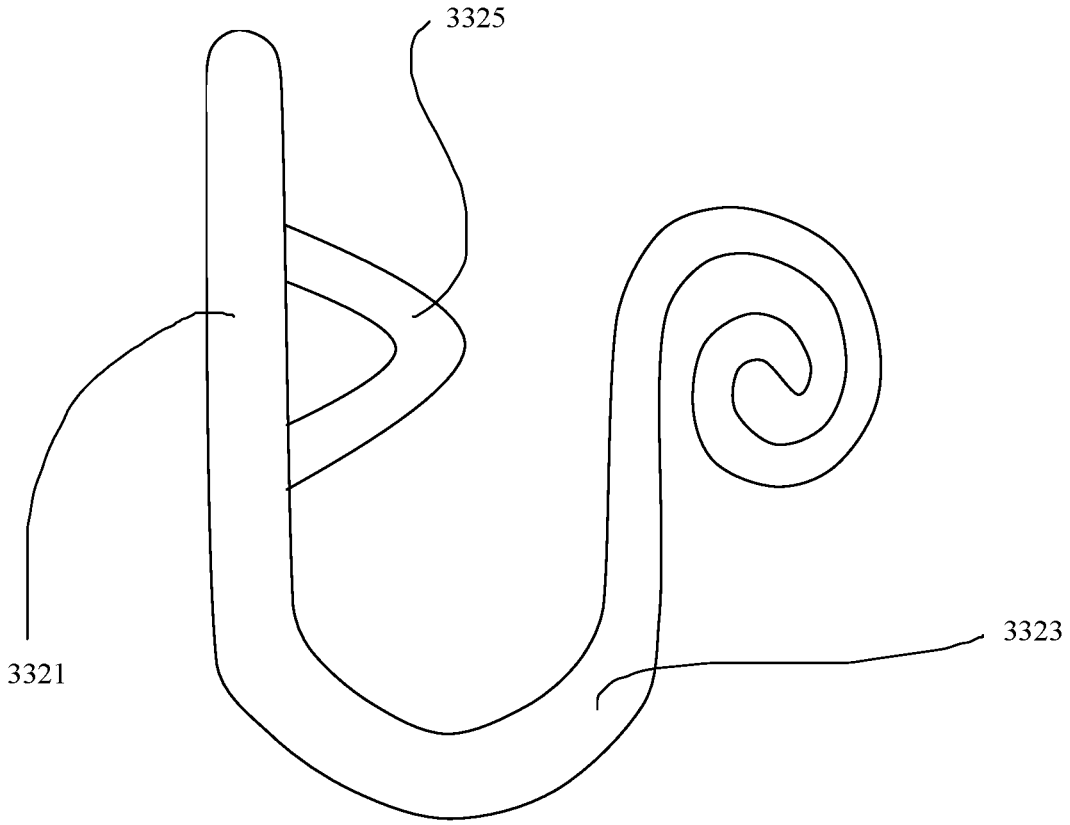
FIG. 11 is a schematic view illustrating a first contact portion according to an embodiment of the present disclosure.

FIG. 11 is a schematic view illustrating a first contact portion according to an embodiment of the present disclosure. Referring to FIG. 11, an end of the first contact portion 3323 has a contact end formed in a round shaped 3325. The end of the metal terminals configured in the installation slots includes a fourth side portion 3321 and a fifth side portion opposite to the fourth side portion 3321, the fourth side portion 3321 and the fifth side portion abut against the installation slots. The first contact portion 3323 and a second contact portion are connected to the first side portion and the second side portion respectively. The first contact portion 3323 extends toward the second contact portion. The second contact portion extends toward the first contact portion 3323, and the first contact portion 3323 and the second contact portion cooperatively formed a horn-shaped through a hole.

The invention claimed is:

1. A lighting apparatus, comprising:

a housing;

a supporting structure disposed on an inner surface of the housing;

a rotating frame disposed within the housing, wherein the rotating frame is rotated on the supporting structure;

a light emitting assembly comprising a heat sink and a circuit board, and the circuit board configured within the heat sink;

wherein a driving circuit is connected to a light source and a power socket structure is connected to a power supply to provide a power to the lighting apparatus on the circuit board, and the light emitting assembly is connected to the rotating frame a guiding frame, wherein the guiding frame is generally ring-shaped, and at least two portions of the guiding frame penetrate through the housing via a plurality of guiding slots of the housing to form the supporting structure, and the rotating frame rests on the portions of the guiding frame, and the light emitting assembly and rotating frame are supported by the supporting structure allowing the light emitting assembly and rotating frame to rotate together on the guiding frame.

2. The lighting apparatus of claim 1, wherein the guiding frame comprises a first top portion, and a first side portion, the first top portion is connected to the first side portion, a guiding element is formed on one end of the first side portion opposite to the first top portion, and the guiding element extends along a direction opposite to a radial direction of the guiding frame.

3. The lighting apparatus of claim 2, wherein the guiding frame is formed by a plurality of segments connecting to each other.

4. The lighting apparatus of claim 2, wherein the rotating frame is generally ring-shaped and comprises a second side portion, a first bottom portion and a third side portion connecting in sequence, the first bottom portion abuts against the guiding element, and the second side portion abuts against an inner surface of the housing.

5. The lighting apparatus of claim 4, wherein the guiding element further comprises a first limiting protrusion on the guiding element and extending along a direction, the direction is opposite to a radial direction of the guiding frame, the rotating frame comprises a second limiting protrusion extending along the direction, the direction is parallel to an axial direction of the guiding frame, and the first limiting protrusion interferes with the second limiting protrusion.

6. The lighting apparatus of claim 5, wherein a switch module is on the first limiting protrusion, the switch module is electrically connected to the driving circuit and is to transmitting a turn-off signal to the driving circuit upon the first limiting protrusion interfering with the second limiting protrusion, and the driving circuit is to turn off the light apparatus when receiving the turn-off signal.

7. The lighting apparatus of claim 4, wherein a first cantilever and a second cantilever are formed to a side of the first bottom portion away from the second side portion, and the first cantilever and the second cantilever are opposite to each other and are to hold the light emitting assembly.

8. The lighting apparatus of claim 7, wherein each of the first cantilever and the second cantilever comprises a first connecting portion connected to the first bottom portion and a second connecting portion connected to the first connecting portion and the light emitting assembly, and the first connecting portion and the second connecting portion are in a 7 shape.

9. The lighting apparatus of claim 8, wherein the second connecting portion has a third limiting protrusion, the heat sink comprises a limiting slot corresponding to the third limiting protrusion, the third limiting protrusion is connected to the limiting slot, the light emitting assembly is connected to the rotating frame.

10. The lighting apparatus of claim 1, wherein the heat sink comprises a reflective optic being on an inner surface of the heat sink, and the reflective optic has a wave-shaped surface.

11. The lighting apparatus of claim 1, wherein the lighting apparatus further comprises a lighting fixture connecting structure being on the housing, and the lighting fixture connecting structure fixing the lighting apparatus to an external lighting fixture.

12. The lighting apparatus of claim 11, wherein the lighting fixture connecting structure comprises a bar, a first elastic sheet holder, and a second elastic sheet holder, each of the first elastic sheet holder and the second elastic sheet holder comprises a holding portion and a fixing portion connected to one end of the holding portion, the holding portion substantially extends along a direction parallel to a longitudinal direction of the bar and is on the bar, the fixing portion is substantially perpendicular to the holding portion, a guiding groove is formed on each of the holding structures along the longitudinal direction of the bar, a first fastener penetrates through the guiding groove, and the first fastener is movably connected to the first elastic sheet holder on the bar.

13. The lighting apparatus of claim 12, wherein the lighting fixture connecting structure further comprises an at least one adjusting member, the at least one adjusting member extends along the direction parallel to the longitudinal direction of the bar, a first end of a adjusting member is fixed to a side of the bar, and a second end of the adjusting member is movably fixed to the side of the holding portion.

14. The lighting apparatus of claim 13, wherein a plurality of notches is on the side of the holding portion corresponding to the second end of the at least one adjusting member, the at least one adjusting member comprises an adjusting protrusion extending along a direction facing toward the bar, and the adjusting protrusion is movably fixed to one of the plurality of notches.

15. The lighting apparatus of claim 13, wherein the at least one adjusting member is fixed to the bar via a fixing part extending from the bar, the at least one adjusting member further comprises a first positioning side wall and a second positioning side wall being on the end of the at least one adjusting member fixing to the bar, the first positioning side wall is adjacent to the second positioning side wall, and the first positioning side wall and the second positioning side wall extend along a direction facing toward the bar and abut against two adjacent sides of fixing part.

16. The lighting apparatus of claim 1, wherein the power socket structure comprises a shell and a plurality of metal terminals, a plurality of openings is formed on a side of the shell, a plurality of installation slots is formed on an opposite side of the shell, the plurality of openings respectively corresponds to the plurality of installation slots, an end of the plurality of metal terminals is in one of the plurality of installation slots, and another end of the plurality of metal terminals electrically connects to the circuit board.

17. The lighting apparatus of claim 16, wherein the end of the plurality of metal terminals is in the plurality of installation slots, and the end of the plurality of metal terminals comprises a fourth side portion and a fifth side portion opposite to the fourth side portion, the fourth side portion and the fifth side portion abut against the plurality of installation slots, a first contact portion and a second contact portion are connected to the first side portion and the second side portion respectively, the first contact portion extends toward the second contact portion, the second contact portion extends toward the first contact portion, and the first contact portion and the second contact portion cooperatively form a horn-shaped through hole.

18. The lighting apparatus of claim 17, wherein an elastic protrusion is formed on the first side portion and extends toward the first contact portion.

19. The lighting apparatus of claim 17, wherein the end of the first contact portion has a contact end formed in a round shape.

* * * * *